US006595565B2

(12) United States Patent
Whiting et al.

(10) Patent No.: US 6,595,565 B2
(45) Date of Patent: Jul. 22, 2003

(54) CARPET-STRETCHING DEVICE

(75) Inventors: John Whiting, London (GB); Stephen L. Szabo, Greifensee (CH); David Hume, Stafford (GB)

(73) Assignee: Stikatak Limited, South Ruislip (GB)

( * ) Notice: Subject to any disclaimer, the term of this patent is extended or adjusted under 35 U.S.C. 154(b) by 0 days.

(21) Appl. No.: 09/948,197

(22) Filed: Sep. 7, 2001

(65) Prior Publication Data

US 2002/0047282 A1 Apr. 25, 2002

(30) Foreign Application Priority Data

Sep. 29, 2000 (DE) ..... 200 16 850

(51) Int. Cl.[7] ..... A47G 27/04; E04F 21/20
(52) U.S. Cl. ..... 294/8.6; 254/200
(58) Field of Search ..... 294/8.6; 254/200, 254/201, 209–212

(56) References Cited

U.S. PATENT DOCUMENTS

| | | | | | |
|---|---|---|---|---|---|
| 60,216 | A | | 12/1866 | Martindale | |
| 2,184,019 | A | * | 12/1939 | Owens | 16/16 |
| 2,602,952 | A | * | 7/1952 | Ownes | 16/16 |
| 2,714,274 | A | * | 8/1955 | Hill | 294/8.6 |
| 2,882,642 | A | * | 4/1959 | Hill | 254/200 |
| 3,374,023 | A | * | 3/1968 | Hill et al. | 294/19.1 |
| 3,572,800 | A | * | 3/1971 | Graziano | 254/200 |
| 3,599,936 | A | | 8/1971 | Crain, Jr. | 254/62 |
| 4,084,787 | A | | 4/1978 | Kowalczyk | 254/57 |
| 4,538,846 | A | | 9/1985 | Alexander | 294/8.6 |
| 5,129,696 | A | * | 7/1992 | Underwood | 254/200 |
| 5,190,328 | A | * | 3/1993 | Anderson | 294/8.6 |
| 5,516,170 | A | * | 5/1996 | Kruskamp | 254/200 |

FOREIGN PATENT DOCUMENTS

| | | |
|---|---|---|
| GB | 1112540 | 5/1968 |

OTHER PUBLICATIONS

"Instructions and Parts List for 10–412 Knee–Kicker", Roberts Consolidated Industries, Inc., No Date.

* cited by examiner

*Primary Examiner*—Dean J. Kramer
(74) *Attorney, Agent, or Firm*—Thomas Schneck

(57) ABSTRACT

A carpet-stretching device for stretching a carpet laid over a floor onto a fixing strip. The device includes: a shank having a first end and a second end; a head portion carrying a plurality of carpet engaging pins provided at the first end of the shank; and an end portion provided at the second end of the shank. The shank, head portion, and end portion are generally linearly arranged so that the application of a force to the end portion, in use, tends to drive the carpet in a direction that is generally parallel to the device rather than towards the floor.

16 Claims, 4 Drawing Sheets

FIG._6
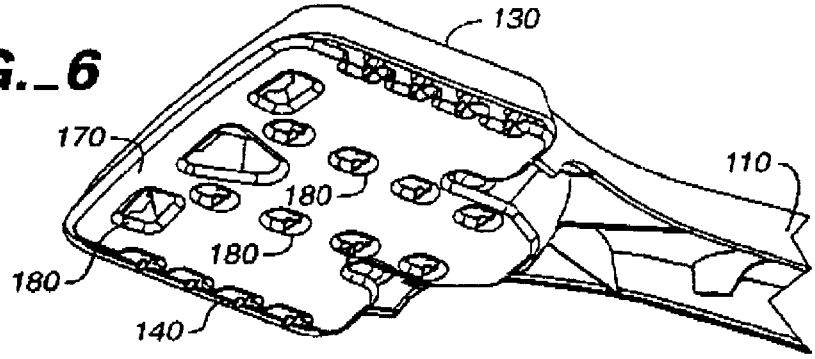
FIG._7
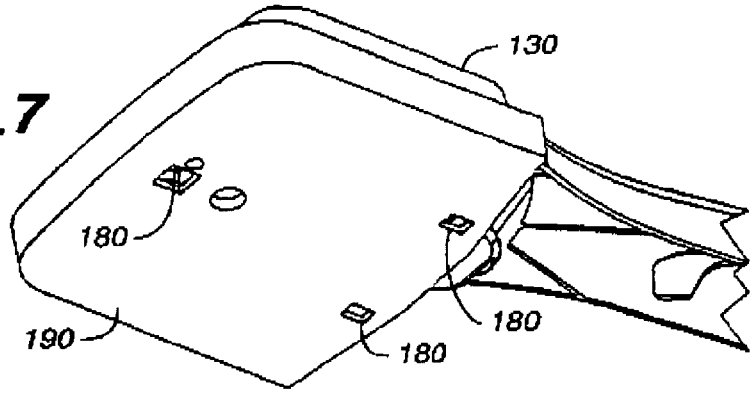
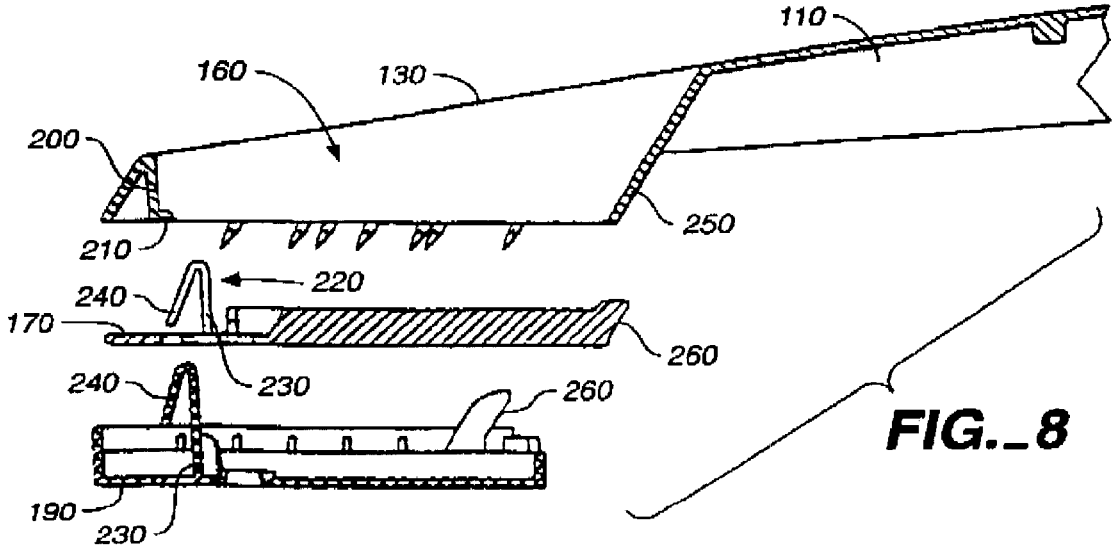
FIG._8

CARPET-STRETCHING DEVICE

BACKGROUND OF THE INVENTION

1. Field of the Invention

This invention relates to carpet-stretching devices, and in particular to devices for stretching carpets over a fixing strip (such as a wooden bar with upwardly projecting pins) secured to a floor.

2. Description of the Prior Art

Known devices of this kind are often referred to in the art as "knee kickers".

One such knee kicker is shown in U.S. Pat. No. 2,882,642 (to Harvey J. Hill), and is illustrated schematically in FIGS. 1 and 2. As shown in FIG. 1, this prior art device 1 comprises a head portion 10 that is attached to a padded end portion 20 by means of a longitudinal shank 30.

The shank 30 is adjustable for length, and the head portion 10 is provided with an adjusting dial 40 (and associated hidden mechanism) that permits the exposed length of a number of carpet engaging pins 50 (see FIG. 2) to be adjusted.

As shown in FIG. 2, the underside of the head portion 10 is provided with a plurality of the aforementioned pins 50. Rotation of the adjusting dial 40 causes a carrier body 60—to which the pins 50 are attached—to be wound up or down (depending upon the direction of rotation) a threaded bolt 70 to which the adjusting dial 40 is connected.

It is apparent therefore that by rotating the dial 40 it is possible to adjust the extent to which the pins project from the underside of the head portion 10, and hence the extent to which the pins will engage a carpet in use.

To use this prior art device, the carpet layer first sets (using the adjusting dial 40) an appropriate projection extent for the pins 50 in dependence upon the thickness of the carpet he is laying. For example, for thicker carpets (such as so-called deep pile carpets) the pins can be set to project a relatively large distance from the underside of the head portion 10. For thin carpets the projection distance is reduced so that there is less chance of the pins becoming engaged with any underlay provided beneath the carpet.

Once the correct pin projection has been selected, the kicker is placed on top of the carpet near a fixing strip to which the carpet is to be attached. With the head portion pointing towards the fixing strip, the carpet layer then pushes down on the head to engage the pins with the carpet.

When the pins are engaged with the carpet, the carpet fitter then kicks the padded end portion 20, for example by means of his knee, to stretch the carpet over the pins of the fixing strip that has been secured to the floor.

Devices of this kind have proved useful for many years, but it has recently been noted that there are a number of problems and disadvantages associated with them.

For example, it will be noted from the above that these devices have a large number of constituent parts, and as a consequence of this the devices are relatively expensive to manufacture and hence expensive to purchase.

Another serious problem is associated with the fact that this prior art device weighs in excess of two kilograms, and as a result it is a heavy piece of equipment for a carpet fitter to have to carry from one job to another. The weight of the device is such that it requires the carpet fitter to exert a significant amount of effort fitter just to get the device moving. This means that the device can be quite exhausting to use. It has also been noted that carpet fitters often have injured knees, and it has been postulated that these injuries could well be as a result of repeatedly impacting their knees against these relatively heavy devices.

A further problem associated with these devices is that as they are made up of a number of moving parts (such as the length-adjustable shank and the adjustable pins), a significant proportion of the force transferred to the device when the padded end portion is kicked is absorbed by the moving parts. This means that the moving parts have to be relatively rugged, and hence more expensive than they would otherwise need to be.

Another disadvantage associated with the provision of moving parts is that even when the device is engaged with a carpet it will still be possible to move it to a limited extent. Carpet layers, who would expect there to be no movement of the device, will then be able to sense this movement when the device is used with the result that their confidence in the device will be reduced.

A further disadvantage is associated with the shape of the device. As shown in FIG. 2, the shank 30 is bent generally at right angles where it connects to the head portion 10, and this means that any force applied to the padded end portion will be directed (by the bent shank) down towards the floor (as illustrated by arrow 90). Applying the force to the floor in this way often causes the head portion to move away from the floor, and become detached from the carpet, when the padded end portion is kicked. This can cause the carpet to be damaged. Even if the head portion does not come away from the carpet, driving it downwards can be problematic in itself as it can cause the pins to engage any underlay provided beneath the carpet.

It is also apparent that effort applied when the head comes away from the carpet is largely wasted effort, and it would be desirable to reduce this so that the device is less exhausting to use.

A further problem associated with this device is that it is difficult to release the head portion from the carpet without also pulling the carpet off the pins of the fixing strip. In other words, it is not possible when using this known device to hold the carpet to the fixing strip when the device is removed.

U.S. Pat. Nos. 3,374,023 and 2,714,274 (also to Harvey J. Hill) disclose other carpet stretching devices that suffer from the problems and disadvantages discussed above.

SUMMARY OF THE INVENTION

It is an object of the present invention to address, and preferably alleviate, at least some of the problems identified above.

One object of a preferred embodiment is to provide a carpet-stretching device that is less expensive to manufacture, and hence less expensive to purchase.

Another object of the invention is to provide a carpet-stretching device which not as heavy as the aforementioned prior art devices.

Another object of a preferred embodiment is to provide a carpet-stretching device that does not include any moving parts.

Yet another object of a preferred embodiment is to provide a carpet-stretching device that is shaped to reduce the force applied to the carpet in a downward direction when the padded end portion is kicked. In other words, it is an object of a preferred embodiment to provide a carpet-stretching device that is less likely to come away from the carpet when the padded end portion is struck.

Yet another object of a preferred embodiment is to provide a carpet-stretching device that can more easily be released from the carpet once the carpet has been stretched.

In pursuit of the aforementioned objects, one presently preferred embodiment of the invention provides a carpet-stretching device for stretching a carpet laid over a floor onto a fixing strip, the device comprising: a shank having a first end and a second end; a head portion carrying a plurality of carpet engaging pins provided at said first end of said shank; and an end portion provided at said second end of said shank, wherein the shank, head portion, and end portion are generally linearly arranged so that the application of a force to said end portion, in use, tends to drive said carpet in a direction that is generally parallel to the device rather than towards said floor.

This embodiment of the invention is advantageous over the prior art since the device is less likely to come away from the floor when struck.

Preferably, the head portion is provided with a number of longitudinal holes. These holes allow pressure to be applied to the carpet to fix it to the strip without having first to remove the carpet-stretching device.

Preferably, the shank, head portion, and end portion are integrally formed as one piece. This is advantageous since the device no longer has any moving parts, and because the device can be manufactured (and hence sold) less expensively than the aforementioned prior art device.

The device may be formed by die-casting (in which case it is preferably of aluminum), or alternatively it may be formed by injection moulding (in which case it is preferably of plastics).

Preferably, the pins are irregularly arranged in four longitudinal rows across an underside of the head portion.

Preferably, the device comprises a distance plate fittable to an underside of said head portion, wherein the distance plate comprises a plurality of holes through which said pins can project. A plurality of distance plates may be provided, each of a different thickness.

Preferably, the device comprises a cover plate fittable to an underside of said head portion to cover said pins.

Preferably, a pad is affixed to said end portion. Preferably, said shank extends generally from the middle of said end portion.

Preferably, the carpet-stretching device further comprises a cover plate fittable to an underside of said head portion to cover said pins, and a pad affixed to said end portion, and said device, pad and cover plate together weigh less than 600 grams.

Preferably, the device weighs less than 400 grams. Another aspect of the invention relates to a carpet-stretching device for stretching a carpet laid over a floor onto a fixing strip, the device comprising: a shank having a first end and a second end; a head portion carrying a plurality of carpet engaging pins provided at said first end of said shank; and an end portion provided at said second end of said shank, wherein: the shank, head portion, and end portion are generally linearly arranged so that the application of a force to said end portion, in use, tends to drive said carpet in a direction that is generally parallel to the device rather than towards said floor; the head portion, shank and end portion are integrally formed as one piece; and the head portion is provided with a plurality of longitudinal holes to permit access to said carpet when said device is laid thereover.

Another aspect of the invention relates to a carpet-stretching device for stretching a carpet laid over a floor onto a fixing strip, the device comprising: a shank having a first end and a second end; a head portion carrying a plurality of carpet engaging pins provided at said first end of said shank; and an end portion provided at said second end of said shank, wherein the shank, head portion, and end portion together weigh less than 450 grams.

Preferably, the shank, head portion, and end portion are integrally formed as one piece.

Preferably, the head portion is provided with a plurality of longitudinal holes to permit access to said carpet when said device is laid thereover.

Other features and advantages of the invention will become apparent once the following non-limiting description has been read and understood.

BRIEF DESCRIPTION OF THE DRAWINGS

Embodiments of the present invention will now be described—by way of non-limiting example only—with reference to the following drawings, in which:

FIG. 6 is a partial view of the underside of a head portion of the device shown in FIG. 3 with a distance plate fitted thereto;

FIG. 7 is view of the underside of the head portion of FIG. 6 with a protective cover fitted thereto; and FIG. 8 is an exploded view in vertical section of the head portion of FIG. 7.

DETAILED DESCRIPTION OF PREFERRED EMBODIMENTS

Before describing preferred embodiments of the invention it is worth noting at this juncture that whilst the preferred embodiments have been described with reference to tools for fitting carpets, it will be obvious to one of ordinary skill in the art that the tools may be employed to fit other types of floor-covering. As a consequence, references herein to a "carpet" should not be construed to exclude other types of floor-covering.

Figure 1:
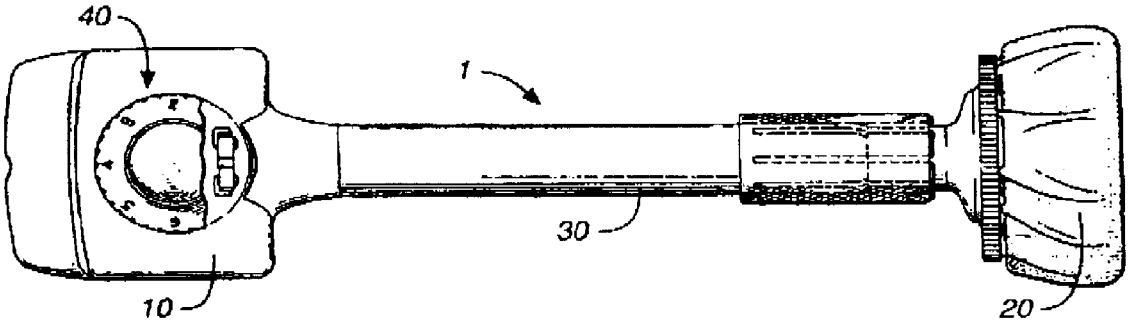
FIG. 1 (PRIOR ART)
FIG. 1 is a plan view of a prior art carpet-stretching device.
Figure 2:
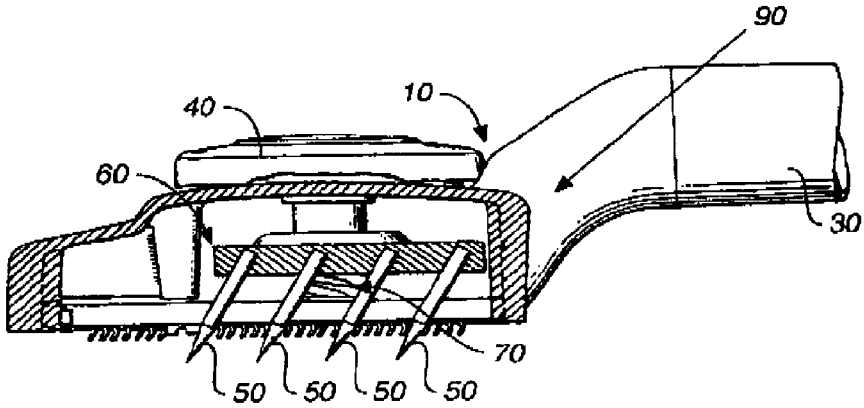
FIG. 2 (PRIOR ART)
FIG. 2 is a side sectional view of a head portion of the prior art device shown in FIG. 1.
Figure 3:
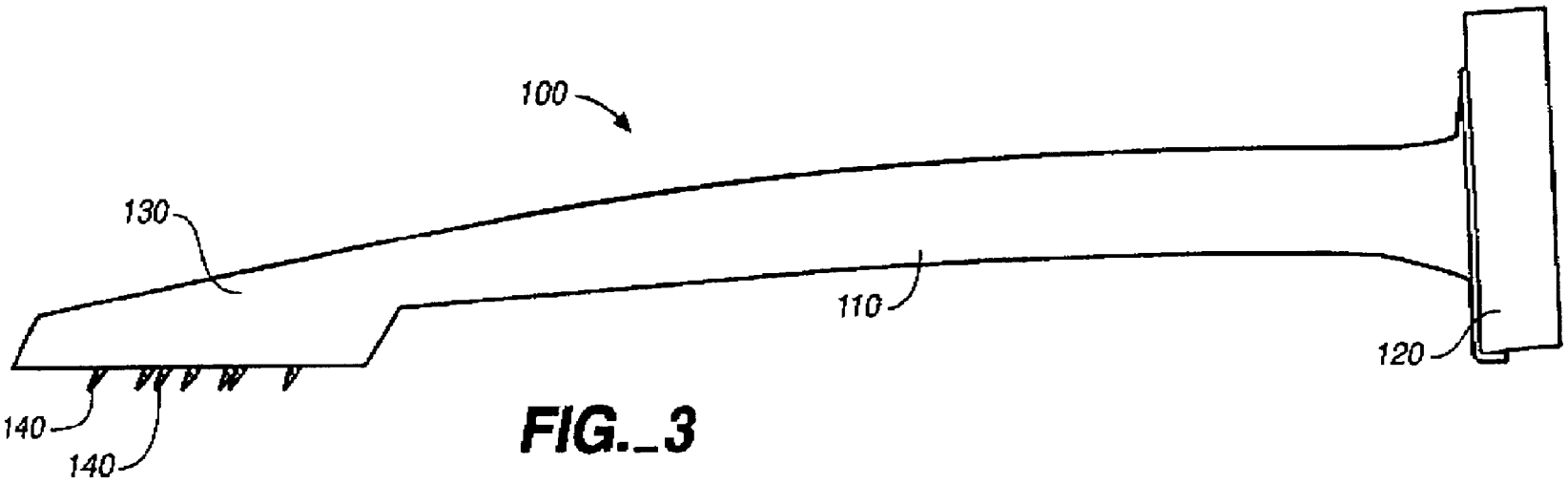
FIG. 3 is a side view of the carpet-stretching device of a preferred embodiment of the invention.

As mentioned above, FIGS. 1 and 2 are views of a prior art carpet-stretching device. FIG. 3 shows a carpet-stretching device in accordance with an embodiment of the invention.

As shown in FIG. 3, the device 100 comprises a shaft 110, a padded end portion 120 which is provided at one end of the shaft 110 and a head portion 130 provided at the other end of the shaft 110. As shown in FIG. 3, and also in FIG. 5, the head portion 130 has a plurality of pins 140 provided on the underside thereof.

Preferably, the padded end portion comprises a generally rectangular plate to which a pad (such as a rubber pad) has been secured. The plate has an area that is significantly greater than the cross-sectional area of the shank. In a highly preferred embodiment the shank extends from roughly the centre of the padded end portion.

Figure 5:
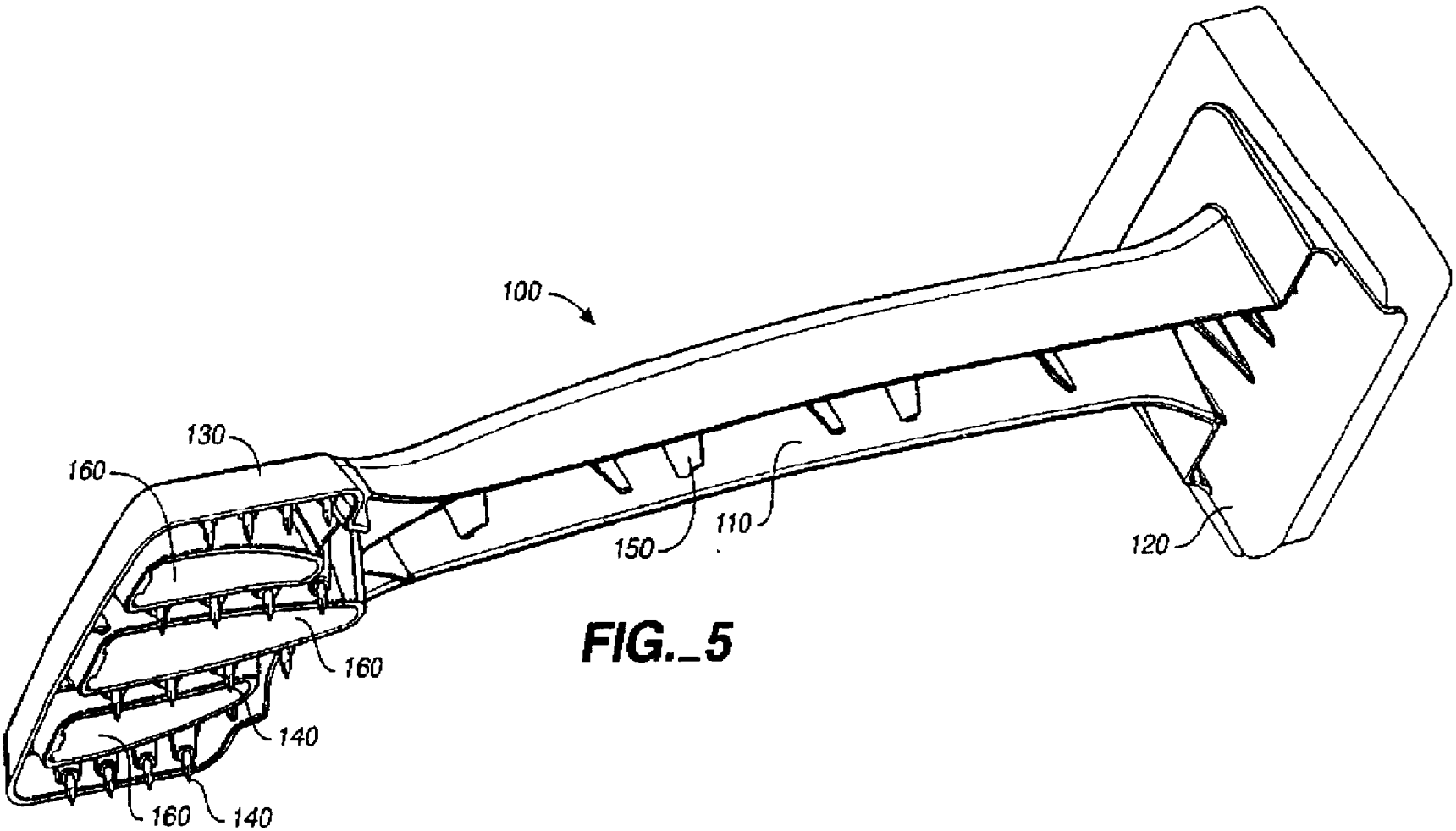
FIG. 5 is a perspective underneath plan view of the device shown in FIG. 3.

The device 100 is manufactured as a single piece, and the shaft 110 is generally "C" shaped in cross-section, opening to its underside. As shown in FIG. 5, the shaft 110 is formed with a plurality of lateral ribs 150 that serve to strengthen the otherwise hollow shaft.

The device may be formed by die-casting, or alternatively by injection-moulding. If the device is to formed by die-casting, then it is preferred that it is of aluminum so that its weight is kept acceptably low. On the other hand, if the device is to be formed by injection moulding, then it is preferred that a suitable plastics material is injected into a suitably shaped mould. Whilst these manufacturing methods and materials are preferred it will be apparent to persons skilled in the art that alternative materials and manufacturing methods may instead be employed.

In either case, the device of the preferred embodiment has a weight that is very much less than the weight of the prior art device (which is typically more than two kilograms). The device of the preferred embodiment, when formed of aluminum for example, typically weighs less than 600 grams when a protective cover 190 is fitted over the pins 140 and padding is attached to the end portion 130. Without the padding and cover, the device typically weighs less than 400 grams, generally in the region of 350 grams.

By reducing weight the portability of the device is much improved over the prior art, and the effort required to use the device is much reduced. Another advantage associated with this weight reduction is that the device has a lesser resistance to motion than the prior art device, and thus is less likely to injure a carpet fitter's knee, or exacerbate any existing injuries than the prior art device.

The shape of the device 100 is such that when the device is placed on a carpet-to-be-stretched, the shaft 110 will be spaced from the carpet. As shown, the device is shaped so that it is substantially linear (i.e. generally in a straight line) so that a force applied to the padded knee-pressure plate 120 will tend to move the pins 140, and hence the carpet, in a direction that is generally parallel to the device (i.e. generally parallel to the direction in which the carpet is to be stretched). This is in contrast to the prior art device shown in FIGS. 1 and 2 where the shank is bent so that the application of a force to the padded end portion tends to drive the pins downward into engagement with the carpet (which can cause damage to the carpet and/or underlay).

Effectively, the device is shaped so that the application of a force to the end portion, in use, tends to drive the carpet in a direction that is generally parallel to the device rather than towards the floor. By this we mean that a component of the force applied to the carpet in a direction generally parallel to the device will be greater in the device of the invention than in the device of the prior art. Similarly, a component of the force applied to the carpet in a direction towards the floor will be greater in the prior art device than in the device of the invention.

Figure 4:
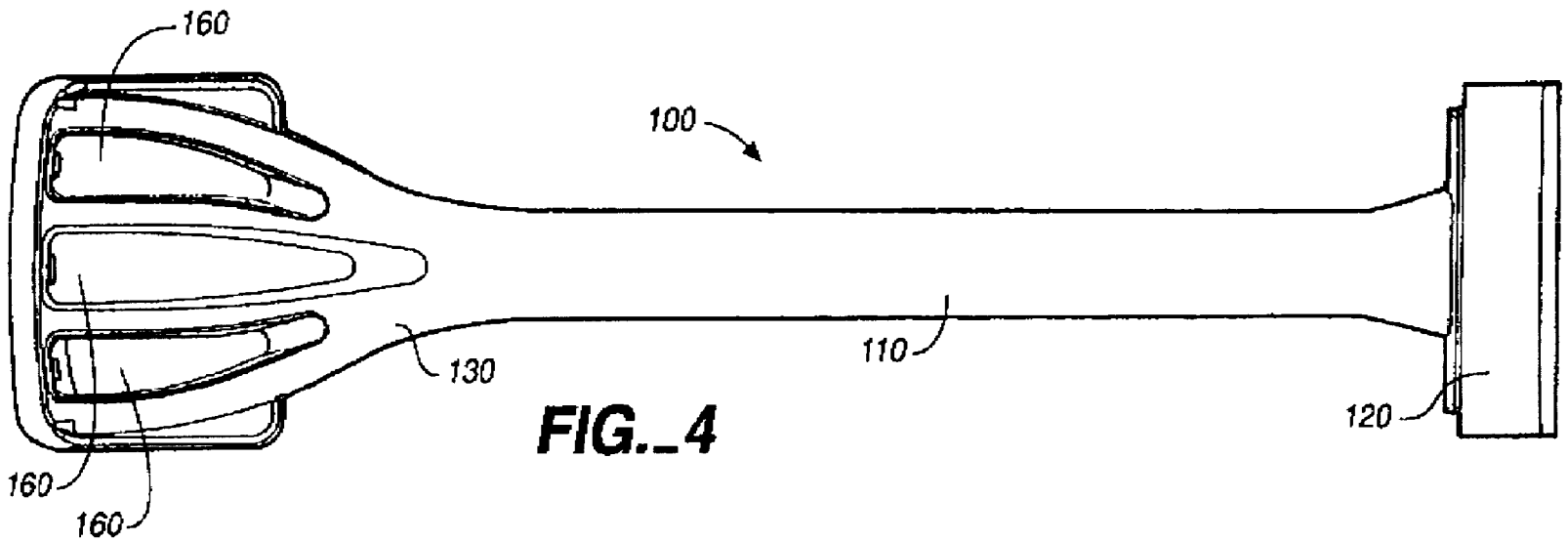
FIG. 4 is a view in plan of the device shown in FIG. 3.

As shown in FIG. 4, the head portion 130 is formed with a plurality of longitudinal openings 160 that extend through the head portion and between adjacent rows of pins 140. The openings are provided to enable a carpet layer to pass his fingers through the openings and press onto the carpet to firmly secure the carpet to the pins of the fixing strip secured to the floor underneath the carpet. The openings can also be used by the carpet fitter to enable him to hold the carpet in place whilst the device is lifted off the carpet.

In the preferred embodiment, as shown, the head portion 130 is provided with three longitudinal openings 160, and four rows of pins 140.

As shown in FIG. 5, it is preferred that the pins 140 are located irregularly on the underside of the head portion 130 so that there is less chance of the carpet tearing in the unfortunate event that all of the pins engage in the direction of tread of the carpet's backing fabric.

As mentioned above, it is an advantage of the carpet-stretching device of an embodiment of the invention that it does not comprise any moving parts. However, there will still be circumstances where it will be necessary to vary the extent to which the pins 140 project from the underside of the head portion 130.

In such circumstances a plurality of distance plates 170 are provided to enable the projecting distance of the pins to be varied. FIG. 6 illustrates one such plate 170 secured to the underside of the head portion 130.

Preferably, a plurality of distance plates 170 of varying thickness are provided so that the projecting distance of the pins can be fully adjusted. The plates are formed with holes 180 through which the pins can project, and can be firmly secured to the underside of the of the head portion 130.

In the preferred embodiment, the distance plates 170 can be provided with different surface structures so that they increase force transmission to the carpet. For example, the underside of the distance plate (which abuts against the carpet in use) could be coated with a rubber material so that it firmly grips the surface of the carpet.

It is also conceivable for a low-impact distance plate, not shown, to be provided which is designed to cover the pins entirely. This plate would have an underside surface that resembles a wire brush for example, and which would engage with the carpet to apply pressure to the carpet across the whole of the underside of the head portion 130. Such a plate could be used in circumstance where a carpet would otherwise have been damaged if it were to be engaged by the pins 140.

Since the pointed pins 140 could cause injury it is preferred to provide a protective cover 190 which can be fitted, as shown in FIGS. 7 and 8, to the underside of the head portion 130 to cover the pins 140. In the preferred embodiment, it is not necessary to remove any distance plate fitted to the head portion 130 before attaching the cover thereto.

The distance plates, and protective cover, are secured to the underside of the head portion by means of a suitable interlocking engagement mechanism. A variety of such mechanisms will be apparent to persons skilled in the art, and one example is shown in FIG. 8.

As shown, leading edges 200 of the longitudinal holes 160 (one of which is visible) are provided with tabs 210 that extend into the holes.

The distance plates and cover plate are provided with an upstanding locking arm 220 which comprises a generally vertical portion 230 and an inclined portion 240 extending towards the aforementioned leading edge 200. When a distance plate or the cover plate is attached to the underside of the head portion, the inclined portion 240 is resiliently biased towards the vertical portion 230 until the inclined portion passes by the tab 210. Once past the tab 210 the inclined portion 240 springs away from the vertical portion 230 and engages behind the tab 210 to resist removal of the plate or cover.

Release of the plate or cover can be accomplished simply by pushing the inclined portion back towards the vertical portion whereupon the plate or cover can then be removed from the head portion.

A similar arrangement may be provided at a trailing edge 250 of the longitudinal hole. Alternatively (and more preferably), the trailing edge of the plate or cover is simply provided with an upstanding engagement arm 260 that extends at an angle away from a leading edge of the plate or cover. The engagement arm can be slotted into the hole, and then the leading edge of the plate or cover can be pushed up towards the underside of the head portion until the inclined portion 240 of the locking arm 220 snaps behind the tab 210.

As mentioned above, alternative locking arrangements will be apparent to persons skilled in the art.

Although exemplary and/or illustrative embodiments of the invention has been disclosed herein for purposes of illustration, it will be understood that various changes, modifications and substitutions may be incorporated into those embodiments without departing from the spirit and scope of the invention as defined by the scope of the claims which follow and any equivalents thereto.

What is claimed is:

1. A carpet-stretching device for stretching a carpet laid over a floor onto a fixing strip, the device comprising:

(i) a shank having a first end and a second end;

(ii) a head portion carrying a plurality of carpet engaging pins formed at said first end of said shank; and (iii) an end portion formed at said second end of said shank, wherein:

the shank, head portion, and end portion are generally linearly arranged so that the application of a force to said end portion, in use, tends to drive said carpet in a direction that is generally parallel to the device rather than towards said floor; and the shank, head portion, carpet engaging pins and end portion are integrally formed as a one-piece unit so that, in use, no relative movement occurs between each of said shank, said head portion, said carpet engaging pins and said end portion.

2. A carpet-stretching device as claimed in claim 1, wherein the head portion is provided with a number of longitudinal through-holes, each of said through-holes being provided to permit access to said carpet, said access being provided to allow a user of the device to hold the carpet onto the fixing strip whilst the device is disengaged from the carpet.

3. A carpet-stretching device as claimed in claim 1, wherein the device is formed by die-casting.

4. A carpet-stretching device as claimed in claim 3, wherein the device is of aluminum.

5. A carpet-stretching device as claimed in claim 1, wherein the device is formed by injection moulding.

6. A carpet-stretching device as claimed in claim 5, wherein the device is of plastics.

7. A carpet-stretching device as claimed in claim 1, wherein the pins are arranged in four longitudinal rows across an underside of the head portion, wherein each row comprises a plurality of pins, and the pins of each row are offset from the pins of at least one neighboring row to form an irregular pattern of pins.

8. A carpet-stretching device as claimed in claim 1, further comprising a distance plate fittable to an underside of said head portion, wherein the distance plate comprises a plurality of holes through which said pins can project.

9. A carpet-stretching device as claimed in claim 8, further comprising a plurality of said distance plates, each of a different thickness.

10. A carpet-stretching device as claimed in claim 1, further comprising a cover plate fittable to an underside of said head portion to cover said pins.

11. A carpet-stretching device as claimed in claim 1, further comprising a pad affixed to said end portion.

12. A carpet-stretching device as claimed in claim 1, wherein said shank extends generally from the middle of said end portion.

13. A carpet-stretching device as claimed in claim 1, further comprising a cover plate fittable to an underside of said head portion to cover said pins, and a pad affixed to said end portion, and wherein said device, pad and cover plate together weigh less than 600 grams.

14. A carpet-stretching device as claimed in claim 1, wherein said device weighs less than 400 grams.

15. A carpet-stretching device for stretching a carpet laid over a floor onto a fixing strip, the device comprising: a shank having a first end and a second end; a head portion carrying a plurality of carpet engaging pins provided at said first end of said shank; and an end portion provided at said second end of said shank, wherein:

the shank, head portion, and end portion are generally linearly arranged so that the application of a force to said end portion, in use, tends to drive said carpet in a direction that is generally parallel to the device rather than towards said floor;

the head portion, the carpet engaging pins, the shank and the end portion are integrally formed as a one-piece unit; and the head portion is provided with a number of longitudinal through-holes, each of said through-holes being provided to permit access to said carpet, said access being provided to allow a user of the device to hold the carpet onto the fixing strip whilst the device is disengaged from the carpet.

16. A carpet-stretching device for stretching a carpet laid over a floor onto a fixing strip, the device comprising:

a shank having a first end and a second end; a head portion carrying a plurality of carpet engaging pins formed on said first end of said shank; and an end portion formed on said second end of said shank, wherein the shank, head portion, and end portion are generally linearly arranged so that the application of a force to said end portion, in use, tends to drive said carpet in a direction that is generally parallel to the device rather than towards said floor, and a plurality of removable distance plates that each have a different thickness, and each comprising a plurality of holes through which said pins can project, each of said distance plates being fittable to an underside of said head portion.

* * * * *